US010457518B2

(12) United States Patent
Zaun

(10) Patent No.: US 10,457,518 B2
(45) Date of Patent: Oct. 29, 2019

(54) WINDING MACHINE

(71) Applicant: Georg Sahm GmbH & Co. KG, Eschwege (DE)

(72) Inventor: Jochen Zaun, Elmshorn (DE)

(73) Assignee: GEORG SAHM GMBH & CO. KG, Eschwege (DE)

( * ) Notice: Subject to any disclaimer, the term of this patent is extended or adjusted under 35 U.S.C. 154(b) by 155 days.

(21) Appl. No.: 15/671,936

(22) Filed: Aug. 8, 2017

(65) Prior Publication Data

US 2017/0334676 A1 Nov. 23, 2017

Related U.S. Application Data

(63) Continuation-in-part of application No. PCT/EP2016/053365, filed on Feb. 17, 2016.

(30) Foreign Application Priority Data

Mar. 9, 2015 (EP) ..... 15158293

(51) Int. Cl.
*B65H 54/28* (2006.01)
*B65H 54/54* (2006.01)
*B65H 75/24* (2006.01)

(52) U.S. Cl.
CPC ..... *B65H 54/2803* (2013.01); *B65H 54/2809* (2013.01); *B65H 54/2818* (2013.01); (Continued)

(58) Field of Classification Search
CPC ..... B65H 54/2803; B65H 54/2809; B65H 54/2818; B65H 54/2821
See application file for complete search history.

(56) References Cited

U.S. PATENT DOCUMENTS 2,947,489 A 8/1960 Russell
3,356,307 A 12/1967 Patton
7,866,591 B2 1/2011 Till

FOREIGN PATENT DOCUMENTS

DE 455 581 C 2/1928
DE 103 24 179 A1 12/2004
(Continued)

OTHER PUBLICATIONS

International Preliminary Report on Patentability in co-pending, related PCT Application No. PCT/EP2016/053365, dated Sep. 21, 2017.

*Primary Examiner* — William E Dondero
(74) *Attorney, Agent, or Firm* — Thomas | Horstemeyer, LLP

(57) ABSTRACT

A winding machine (1) for a traversing application of a winding material (51) to a spool sleeve (27) comprises a spindle (8) which is supported for being rotated and for having a fixed axial position. The spindle (8) comprises an inner recess. The winding machine (1) comprises a drive driving the spindle (8) for a rotational movement and a traversing carriage (20). The traversing carriage (20) is supported on the spindle (8) for being movable with a traversing motion (18) in an axial direction relative to the spindle (8). A first coupling element serves for transmitting the rotational movement of the spindle (8) to the traversing carriage (20) and a second coupling element serves for transmitting the traversing motion (18) of the traversing carriage (20) to the spool sleeve (27). The winding machine (1) also comprises an actuation mechanism (30) executing the traversing motion (18). The actuation mechanism (30) is coupled to the traversing carriage (20) for transmitting the traversing motion (18) from the actuation mechanism (30) to the traversing carriage (20). The actuation mechanism (30) extends through the inner recess of the spindle (8).

18 Claims, 10 Drawing Sheets

(52) U.S. Cl.
CPC ..... *B65H 54/2821* (2013.01); *B65H 54/543* (2013.01); *B65H 75/245* (2013.01); *B65H 2701/30* (2013.01); *B65H 2701/31* (2013.01)

(56) References Cited

FOREIGN PATENT DOCUMENTS

| | | | |
|---|---|---|---|
| DE | 10 2010 044 107 | A1 | 6/2011 |
| JP | S48 42032 | Y1 | 7/1973 |
| JP | S 62 88779 | | 4/1987 |
| JP | 2002 241054 | A | 8/2002 |
| WO | 2007/113045 | A1 | 10/2007 |

WINDING MACHINE

CROSS REFERENCE TO RELATED APPLICATIONS

This application is a continuation-in-part (CIP) of international application PCT/EP2016/053365 with an international filing date of Feb. 17, 2016 and claiming priority to co-pending European patent application No. EP 15 158 293.9 entitled "Spulmaschine", filed on Mar. 9, 2015.

FIELD OF THE INVENTION

The present invention relates to a winding machine for winding a winding good into a spool. Preferably, the winding good to be wound is a winding good which is sensitive to redirection and to cross forces induced by redirection. For example, cross forces due to redirections can lead to damages of edges of the winding good, deformations of the winding good or breaks of possible fibres of the winding good. The winding good especially is a yarn or a thread- or ribbon-shaped winding good. Preferably, the winding good is flexible. The winding good can be a single filament or a multifilament (for example with more than 12,000 single filaments up to 300,000 single filaments). For example, the winding good can be ribbons or tapes of any cross section, especially with a rectangular cross section of up to 5×20 $mm^2$ and/or with a cross section with a ratio of width to thickness larger than or equal to 4.0 or 5.0. It is also possible that the winding good is a prepreg material such as carbon or glass fibre ribbons or tapes in a plastic matrix that has not been cured. It is also possible that the winding machine according to the invention is employed for a winding good formed by a carbon fibre ribbon or tape or by stranded (copper) wire. Preferably, winding speeds of up to 1,500 m/min are employed.

BACKGROUND OF THE INVENTION

For the winding of a spool on a spool sleeve on the one hand it is necessary that the spool sleeve is rotated with a rotating motion to wind the winding good onto the surface area of the spool sleeve and a winding being formed as the angle of wrap increases. On the other hand, a traversing motion is necessary to feed the winding good in a traversing way to different axial portions of the spool sleeve and the winding forming on it during the placement. Depending on the coordination of the winding motion of the spool sleeve and the traversing motion, different winding appearances (cp. also DIN ISO 5238) can be produced.

Embodiments of winding machines are known in which upstream of the spool sleeve and the winding forming on it a traversing device is placed to which the winding good is fed from a roller that in turn is arranged upstream. The traversing device comprises a traversing thread guide which is moved back and forth traversingly in parallel to the rotational axis of a spindle on which the spool sleeve with the winding forming on it is arranged. From the traversing thread guide, the winding good depending on the position of the traversing thread guide reaches different axial portions of the spool sleeve and the winding forming. In this regard it can be problematic that in the region of the traversing thread guide (and the roller arranged upstream from the traversing thread guide) a redirecting of the winding good perpendicular to the longitudinal extension is done which for a sensitive winding good, ribbon-shaped winding good or winding good with a non-round, such a as rectangular or flat, cross section can lead to problems, where at worst the redirection of the winding good can lead to damages of the winding good. On the other hand, depending on the position of the traversing thread guide, the length of the path from the roller via the traversing thread guide to the laying position of the winding good onto the spool sleeve and the forming winding changes, in which way additional measures are necessary if the tension in the winding good is to lie in a pre-set tension region during the winding cycle and/or the take-up speed of the winding good by the forming winding is not be dependent on the position and the motion of the traversing thread guide.

The document DE 103 24 179 A1 discloses a winding machine which is said to be suitable especially for winding processes with a ribbon- or strip-shaped winding good with a rectangular or flat cross section with a guarantee of small forces and accelerations effective onto the winding good. The winding machine is said to enable the winding of spools with the winding appearance of a cross-wound package from a delicate winding good. The document proposes for a traversing thread guide moving back and forth traversingly not to be employed. Rather than that, the winding good is fed to the spool via a roller which is not moved traversingly in parallel to the rotational axis of the spindle. Instead, the traversing motion is induced by the rotating spindle being moved back and forth in parallel to the rotational axis of the spindle traversingly relative to the roller together with the transmission and the motor for the driving of the spindle via a further motor. The distance of the roller positioned in front of the spindle from the forming winding is held constant during the winding cycle. This can be achieved by the roller together with a dancer plate supporting the roller (and possibly further rollers) being moved away from the rotational axis of the spindle at increasing diameter of the forming winding. Alternatively, it is suggested that with increasing growth of the diameter of the forming winding the unit formed with the spindle, the transmission and the motor is moved away from the roller in addition to the biasing with the traversing motion transverse to the rotational axis of the spindle.

Another winding machine in which the rotating spindle performs a traversing motion relative to a laying roller for laying the winding good (which here is a winding good in the shape of PP, PE and PET ribbons or tapes, aluminium composite films, coated ribbons or tapes, rubber bands, teflon bands, one-sided or multi-sided adhesive tapes, paper bands, bands of fleeces or prepreg ribbons or tapes) as well, is sold by the applicant under the label of "SAHM 460XE", where cylindrical, biconical spool shapes, disc spools or flange spools can be produced with this winding machine.

The document WO 2007/113045 A1 corresponding to U.S. Pat. No. 7,866,591 B2 proposes a first embodiment in which a spool holder is supported to be axially slidable while transmitting the rotating motion on a spindle equipped with a kind of spline, axially fixed and rotated by a drive. The spool holder via an actuator is moved back and forth axially on the spindle by a catch to induce a traversing motion. For a second embodiment, the motor shaft itself (with the spool holder fixed on it rotationally and axially fixed) is moved back and forth axially and rotated. In order to achieve this, the motor shaft is rotationally fixedly connected to a spindle the inner threading of which is in interaction with a further spindle which is rotated by a first drive. The outer toothing of the first-mentioned spindle engages with a spindle nut which is rotated by a second actuator. Driving the two actuators with the same rotational speeds leads to pure rotation of the motor shaft with the spool holder. If, however, only the first actuator is driven, there is a pure axial motion of the motor shaft with the spool holder. If different rotational speeds of the actuators are overlaid, the motor shaft with the spool holder executes a rotational motion as well as an overlying traversing motion.

According to document JP S 62 88779 A, the winding occurs on a spool body and a spindle which are axially fixed. A conventional traversing device is employed here which is moved back and forth by a reversing screw thread shaft or traverse cam (in the following traverse cam). For this embodiment, therefore the spool body is not moved traversingly with respect to the spindle. For another embodiment, via a spindle drive a rack on which the motor and the spindle are supported is shifted. For this embodiment, therefore, an axial position of the spindle changes.

According to document DE 455 581 C, a spindle is supported axially movably in a bearing. The spindle is driven via a catch spline guided in a longitudinal groove of the spindle which is driven by the drive wheel, while keeping up the axial degree of freedom of shifting. A motion back and forth of the spindle is induced by a traverse cam groove of the spindle into which a catch held via a sleeve fixed to the bearing engages. The overlaid rotational motion and traversing motion of the spindle finally is transmitted onto the winding drum via a friction coupling.

Further prior art is known from documents U.S. Pat. No. 3,356,307 A, JP S48 42032 Y1 and JP 2002 241054 A.

SUMMARY OF THE INVENTION

The invention relates to a winding machine with a spindle the axial position of which does not change during the traversing laying of the winding good onto a spool sleeve and onto a winding forming on the spool sleeve. With the novel winding machine it is in particular possible to propose a winding machine with an alternative possibility for inducing a traversing motion which is especially suitable for winding processes with a delicate winding good. While for such types of construction according to prior art the creation of the traversing motion used to necessitate the employment of a traversing device with a traversing thread guide with the disadvantages mentioned in the beginning connected to this, according to the invention a solution is suggested in which the employment of a traversing device can be dispensed with (where within the framework of the invention additionally a traversing device may be employed):

According to one embodiment of the invention, on the spindle a traversing carriage is supported. The traversing carriage is movable axially relative to the spindle, so that the traversing carriage can execute a traversing motion relative to the spindle which is caused by a suitable drive. The traversing carriage is coupled with the spool sleeve in such a way or at least is able to be coupled temporarily (for example in a friction-locking and/or form-locking way) so that the traversing motion of the traversing carriage is transferable onto the spool sleeve.

One embodiment according to the invention is especially based on the realisation that the basic principles known from the prior art are disadvantageous for the creation of the traversing motion. For example, the use of a traversing device necessitates the undesired redirection of the winding good. If, however (for example according to DE 103 24 179 A1 or according to the product "SAHM 460XE" of the applicant) the entire spindle (possibly also with the assigned transmission and the motor for the drive of the spindle) is moved for the creation of the traversing motion, the drive for creating the traversing motion has to move a comparatively large mass, which can be problematic especially for a fast traversing motion with a fast reversal of direction of movement. Additionally, possibly the storage effort and the construction space increase when a storage of the spindle has to be done in such a way that the spindle can execute a rotational motion as well as a traversing motion.

Avoiding these disadvantages of the known basic principles, one embodiment of the invention suggests a new basic principle in which the spindle does not have to be moved axially and only the traversing carriage carries out the traversing motion, in which way the mass to be moved for the traversing motion can be reduced and still the redirection via a traversing device is unnecessary.

For one embodiment of the invention, a rotating spindle is employed which is driven by a suitable drive. In this case, the traversing carriage is coupled by a first coupling element with the spindle in such a way or can be at least temporarily coupled with the spindle (for example in a friction-locking and/or form-locking way) that the rotating motion of the spindle is transferable onto the traversing carriage. The traversing carriage then is coupled by a second doupling element with the spool sleeve or at least able to be coupled temporarily in such a way that (in addition to the transmission of the traversing motion of the traversing carriage onto the spool sleeve) the rotating motion of the traversing carriage is transmitted onto the spool sleeve. On the spool sleeve then a winding is established by overlaying the rotating motion and the traversing motion of the spool sleeve.

In a winding machine according to one embodiment of the invention, the spindle has an inner recess (which might be a through recess or through bore) in which an actuation mechanism executing the traversing motion (for example an actuation rod) extends. The actuation mechanism extending in the inner recess of the spindle is coupled to the traversing carriage so that the traversing motion of the actuation mechanism (possibly even by a gear transmission ratio for a transmission up and/or down) can be transmitted to the traversing carriage or the traversing sleeve.

While it is generally possible that the coupling of the traversing carriage with the spindle is achieved via any first coupling element such as a clutch, friction-locking or similar, the invention in one embodiment of the winding machine suggests that the traversing carriage is coupled with the spindle via a first coupling element basing upon a form-locking in a circumferential direction. Such a form-locking is an especially dependable possibility for the transmission of the drive torque for the creation of the rotating motion of the traversing carriage. On the other hand, via such a form-locking in the circumferential direction the axial degree of freedom of the traversing carriage with respect to the spindle can possibly still be guaranteed in a very simple way. To mention only some non-limiting examples, the form-locking in the circumferential direction can be guaranteed by engagement of a protrusion of the traversing carriage into a longitudinal groove of the spindle (or a radial protrusion of the spindle into a longitudinal groove of the traversing carriage), while with a motion of the protrusion along the longitudinal groove the axial degree of freedom can be guaranteed, where at the same time a kind of guiding can be provided by the engagement of the protrusion with the longitudinal groove.

For the basic realisation of the traversing carriage there are multitudinous possibilities. For one proposal of the invention, the traversing carriage is formed with a kind of traversing sleeve. The traversing sleeve has a (preferably continuous) bore or opening into which or through which the spindle extends. By the bore or opening, the guiding of the traversing sleeve with respect to the surface area of the spindle can already be achieved for the traversing motion. On the other hand, radially on the outer side from the traversing sleeve the spool sleeve can be arranged onto which the winding is to be wound. Possibly, with a radially nested mode of construction of the spool sleeve, the traversing sleeve and the spindle, a very compact, radially small-sized mode of construction results.

In a special realisation of the first coupling element, a catch is mounted with the traversing sleeve which in form-locking way couples the spindle with the traversing sleeve in the circumferential direction. Such a realisation of the traversing carriage with the traversing sleeve and the catch possibly simplifies the production and/or the mounting of the traversing carriage.

It is generally possible that the actuation mechanism extends only through a part of the spindle in the region of the inner recess, for example from a machine frame or even from the side of the machine frame which is turned away from the spindle. In this case, the actuation mechanism can be coupled with the traversing carriage in the end region arranged in the spindle via suitable coupling means through an opening or an elongated hole of the spindle. To mention only a non-limiting example, the coupling means can be formed with a radial pin of an actuation rod extending through an elongated hole of the spindle, where the outer end region of the pin is accommodated glidingly or is received with an interposed rolling bearing in an inner circumferential groove of the traversing carriage. In this case, the inner recess of the spindle may extend only in a partial region of the spindle turned towards the machine frame, while the freely extending end portion of the spindle does not comprise an inner recess or the inner recess may here be closed with a suitable closing means.

For another proposition of the invention, the actuation mechanism executing the traversing motion extends up to the free end portion of the spindle with an actuation rod which extends through the inner recess of the spindle, so that the actuation rod extends along the entire length of the spindle. In the free end region of the spindle, the actuation rod is coupled with the traversing carriage via a coupling device. While for the embodiments explained before, the traversing carriage is driven from the side of the machine frame (which can be achieved radially on the outer side of the spindle or through the inner recess of the spindle), for this proposition of the invention, the traversing motion is at first completely led through the spindle by the actuation rod and is then led via the coupling device radially outwards in the free end portion of the spindle, where then the reversal of the drive motion back in the direction of the machine frame to the traversing carriage occurs.

It is possible that for this embodiment the actuation rod executing the traversing motion rotates with the traversing carriage. In this case, the drive for creating the traversing motion has to be able to accommodate a corresponding rotational motion or between a drive for the creation of the traversing motion and the actuation rod a suitable axial support element has to be arranged which transmits the axial forces for creating the traversing motion but balances the rotating motion of the actuation rod to a non-rotating actuation plunger of the actuator.

For a special proposition of the invention, the coupling device arranged in the free end portion of the spindle comprises an axial support which transmits the traversing motion from the actuation rod onto the traversing carriage but at the same time enables a relative rotational motion of the traversing carriage with respect to the actuation rod. In this case, possibly the actuation rod itself does not execute a rotational motion, but only is subjected to the traversing motion, that is, an axial motion coaxially to the longitudinal axis of the spindle.

A sealing of the inner recess of the spindle and possible bearings arranged here or in the region of the coupling device can be of special importance. For example, the winding process for the winding goods can be connected with a creation of dust or dirt or a release of fibre fragments which can lead to adverse effects on the function of supporting or bearing elements. This can be accommodated for according to one embodiment of the invention by a development of the winding machine in which the coupling device closes off the inner recess of the spindle on the front side.

For the coupling of the traversing carriage with the spool sleeve, multitudinous coupling devices that are in themselves known can be employed. To mention only a non-limiting example, as the coupling device between the traversing carriage and the spool sleeve a coupling device can be employed as described in the document DE 10 2010 044 107 A1 or DE 37 44 600 A1. For a special proposition of the invention, the traversing carriage is able to be coupled with the spool sleeve via a spool sleeve clamping device.

It is possible that for the actuation of the spool sleeve clamping device a suitable actuator clamps clamping jaws with the interior of the spool sleeve. For a special proposition, the spool sleeve clamping device without actuation takes up its clamping position in which the rotational motion of the traversing carriage and/or the traversing motion of the traversing carriage can be transmitted onto the spool sleeve. On the contrary, at actuation the spool sleeve clamping device takes up a release position in which the spool sleeve (and the winding formed on it) can be removed from the traversing carriage and a new spool sleeve can be pushed onto the traversing carriage. This embodiment is based on the realisation that it is advantageous if in any case without actuation for the winding cycle the necessary coupling effect between the traversing carriage and the spool sleeve is guaranteed. Only for the possibly shorter process of the changing of the spool sleeves on the spindle a separate actuation is necessary, in which way the actuation times are possibly reduced. Furthermore, for this embodiment even at a failure of the spool sleeve clamping device the operating security of the winding process can be guaranteed without the possibility of interferences with the winding machine and dangerous operating situations. On the contrary, a possible failure of the winding sleeve clamping device only has an effect for the changing of the spool sleeve.

For a special proposition of the invention, the spool sleeve clamping device is formed with an elastically radially deformable clamping sleeve. In the clamping position, the surface area of the elastically radially deformable clamping sleeve is brought into interaction with the inner surface of the spool sleeve without actuation of the spool sleeve clamping device, which is done preferably in a form-locking and/or friction-locking way. In order to be able to induce the necessary radial deformation, the choice of material and/or the form of the clamping sleeve can be adapted suitably. For example, the clamping sleeve can be realised with at least one front-faced or central slit running in the axial direction, which reduces the radial stiffness of the clamping sleeve in this axial portion of the clamping sleeve. It is also possible that a slit extends in axial direction as well as in a partial circumferential direction so that the slit releases a partial circumferential portion which can be elastically deformed easily with reduced radial stiffness. It is possible that the traversing carriage on the one hand and the spool sleeve on the other hand are realised separately from one another. In a preferred embodiment, however, the traversing carriage integrally forms the spool sleeve, in which way the effort of construction is further reduced and a very compact mode of construction can be induced.

For the induction of the actuation of the spool sleeve clamping device and especially the elastic radial deformation of the spool sleeve there are generally multitudinous possibilities, where any actuator or actuation mechanism can be employed. For the case that for the actuation of the spool sleeve clamping device a further actuator is to be eliminated, one embodiment of the invention suggests that the spool sleeve clamping device in a motion-controlled way is actuated and/or released by the motion of the traversing device. For this realisation, therefore, the actuator responsible for the traversing motion of the traversing carriage can (especially in a special adjustment range such as an end region of the traversing motion or even an adjustment range aside of the path of the normal traversing motion) be responsible for the actuation of the spool sleeve clamping device.

Generally, for the motion-controlled actuation of the spool sleeve clamping device by the motion of the traversing carriage there are multitudinous possibilities. For a winding machine according to one embodiment of the invention, the clamping sleeve has an inclined surface which can be realised for example as a conical inclined surface. In a motion-controlled way controlled by the motion of the traversing carriage, that is, in dependence of the actuation of the actuator for creating the motion of the traversing carriage, the inclined surface can be pressed against an actuation surface which is especially fixed with respect to the machine frame and which preferably is a conical actuation surface. The contact force exerted on the inclined surface by the actuation surface can induce a radial elastic deformation of the clamping sleeve which then is responsible for the induction or release of the connection between the clamping sleeve and the spool sleeve.

As an actuator for the creation of the motion of the traversing carriage, any actuator with any transmission or another driving kinematic can be employed. For one proposition of the invention, in the winding machine a spindle drive is employed. A spindle of the spindle drive is rotated by an electrical drive. On the contrary, a rotationally-fixed but axially slidable spindle nut of the spindle drive is coupled with the traversing carriage for creating and/or transmitting the changing motion. It is alternatively possible that an axially fixed spindle nut of the spindle drive is rotated by an electrical drive. A rotationally fixed but axially movable spindle of the spindle drive is coupled with the traversing carriage in order to cause and/or transmit the traversing motion.

It is also possible that for the creation of the traversing motion an electric linear drive is coupled to the traversing carriage. This can for example be an axial step motor. For example, it is also possible, however, that by means of a rotational electrical drive in a linear drive a coupling element guided for a translational movement such as a tooth rack or continuous belt is moved back and forth.

In an alternative realisation, the invention proposes that in the winding machine a reversing screw thread drive or self reversing screw drive (in the following self reversing screw drive) is present. A traverse cam of the self reversing screw drive is driven by an electrical drive. In a reverse threading of the traverse cam, a rotationally fixed but axially slidably supported reversing screw thread catch or traverse cam catch is guided which is coupled to the traversing carriage.

Advantageous developments of the invention result from the claims, the description and the drawings. The advantages of features and of combinations of a plurality of features mentioned at the beginning of the description only serve as examples and may be used alternatively or cumulatively without the necessity of embodiments according to the invention having to obtain these advantages. Without changing the scope of protection as defined by the enclosed claims, the following applies with respect to the disclosure of the original application and the patent: further features may be taken from the drawings, in particular from the illustrated designs and the dimensions of a plurality of components with respect to one another as well as from their relative arrangement and their operative connection. The combination of features of different embodiments of the invention or of features of different claims independent of the chosen references of the claims is also possible, and it is motivated herewith. This also relates to features which are illustrated in separate drawings, or which are mentioned when describing them. These features may also be combined with features of different claims. Furthermore, it is possible that further embodiments of the invention do not have the features mentioned in the claims.

The number of the features mentioned in the claims and in the description is to be understood to cover this exact number and a greater number than the mentioned number without having to explicitly use the adverb "at least". For example, if an element is mentioned, this is to be understood such that there is exactly one element or there are two elements or more elements. Additional features may be added to these features, or these features may be the only features of the respective product.

The reference signs contained in the claims are not limiting the extent of the matter protected by the claims. Their sole function is to make the claims easier to understand.

BRIEF DESCRIPTION OF THE DRAWINGS

In the following, the invention is further explained and described with respect to preferred exemplary embodiments illustrated in the drawings.

DETAILED DESCRIPTION

Figure 1:
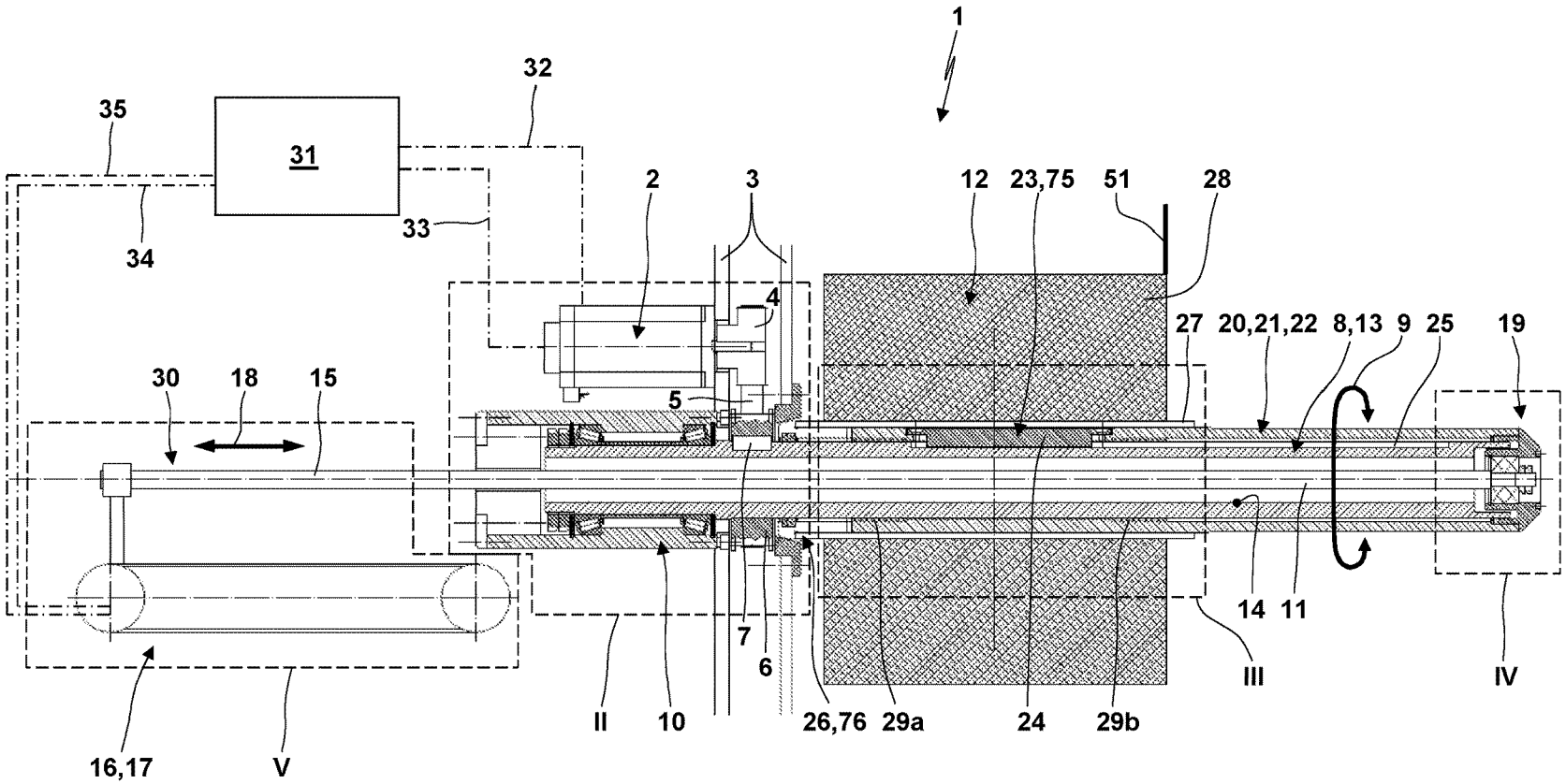
FIG. 1 in a vertical section shows a partial region of a winding machine where a traversing carriage is in a back position.

FIG. 1 shows a winding machine 1. The winding machine 1 has a drive, here an electrical drive 2 which is held on a machine frame 3 of the winding machine 1. A drive wheel 4 driven by the drive 2 is in drive connection with an output-side drive wheel 6 via a traction mechanism 5 such as a toothed belt or a linkage. The output-side drive wheel 6 is rotationally fixedly coupled with a spindle 8, here via a key 7. By actuating the drive 2, with a transmission of gears up or down depending on the transmission ratio between the input-side drive wheel 4 and the output-side drive wheel 6 a rotational motion 9 of the spindle 8 can be induced.

The spindle 8 via a spindle bearing 10 is supported rotatably around a longitudinal and rotational axis 11 on the machine frame 3. The spindle bearing 10 forms a so-called overhung bearing. The spindle bearing 10 is arranged on one side of the machine frame 3 while the freely extending partial region of the spindle 8 in which the spool 12 is wound is arranged on the other side of the machine frame 3.

The spindle 8 is realised as a hollow shaft 13 with a continuous inner bore or recess 14. Through the inner recess 14 of the spindle 8 an actuation rod 15 extends. The end region of the actuation rod 15 extending from the spindle bearing 10 is connected with an actuator 16, which here is a linear drive 17. In the other end region which extends from the spindle 8, the actuation rod 15 via a coupling device 19 is coupled to the traversing carriage 20. By means of the actuator 16, the actuation rod 15 can be moved backwards and forwards coaxially to the rotational axis 11, in which way the actuation rod 15 executes a traversing motion 18.

Here, the traversing carriage 20 is realised with a traversing sleeve 21 which for the embodiment shown is realised integrally with a clamping sleeve 22. The coupling device 19 enables a transmission of axial forces so that via the coupling device 19 the traversing motion 18 is transmitted from the actuation rod 15 onto the traversing carriage 20. The coupling device 19, on the other hand, for the embodiment shown enables a relative rotation of the traversing carriage 20 with respect to the actuation rod 15. As will be explained in more detail in the following, in this way the traversing carriage 20 can perform the rotational motion 9 caused by the drive 2 with the spindle 8, while the actuation rod 15 does not execute a rotational motion 9, which simplifies a coupling of the actuation rod 15 with the actuator 16. (It is possible, however, that the coupling device 19 is not realised with such a relative rotational degree of freedom. In this case, the actuation rod 15 rotates with the traversing carriage 20 while a rotational degree of freedom can be provided in another place, especially in the coupling region of the actuation rod 15 to the actuator 16.)

The traversing carriage 20 is axially slidably but rotationally fixedly guided on the spindle 8. For the embodiment shown, the traversing sleeve 21 with which the traversing carriage 20 is formed in order to achieve this has an opening in which a catch 23 is fixed which for the embodiment shown is achieved by end-sided bolting. The catch 23 and the traversing sleeve 11 (including the bolting) form a plane cylindrical surface area. The catch 23 forms a rib extending with respect to the inner surface of the traversing sleeve 21 or a protrusion 24 which engages with an opening 25 or groove of the surface area of the spindle 8. By the engagement of the protrusion 24 of the catch 23 with the opening 25 of the spindle 8, a form-locking in the circumferential direction is created so that the rotational motion 9 is transmitted from the spindle 8 via the side boundaries of the opening 25, the protrusion 24, the catch 23 onto the traversing sleeve 21 and therefore the traversing carriage 20. The opening 25 is realised with a larger axial extension in the way of an elongated groove or an elongated hole so that the protrusion 24 can move in the opening 25 in the axial direction without eliminating the form-locking in the circumferential direction. This degree of freedom of motion of the protrusion 24 in the opening 25 is dimensioned at least so large that the protrusion 24 and therefore the traversing sleeve 21 and the traversing carriage 20 with respect to the spindle 8 can execute the traversing motion 18 at simultaneous taking along of the traversing carriage 20 by the spindle 8 with respect to the rotational motion 9.

Via a coupling device or spool sleeve clamping device 26, on the traversing carriage 20, here on the traversing sleeve 21, a spool sleeve 27 is held in such a way that the spool sleeve 27 executes

- the traversing motion 18 of the traversing carriage 20 created by the actuator 16 and transmitted via the actuation rod 15 and the coupling device 19 and
- the rotational motion 9 created by the drive 2 and transmitted from the spindle 8 via the catch 23 to the traversing carriage 20.

On the spool sleeve 27 in a way that is known as such a winding 28 of the spool 12 is formed while overlaying the rotational motion 9 and the traversing motion 18. The traversing motion 18 of the traversing carriage 20 leads to an axial relative motion between the traversing carriage 20 and the spindle 8 which is guided by the guiding units 29*a*, 29*b*, especially slide bearings, which are arranged between the inner surface of the traversing sleeve 21 and the surface area of the spindle 8. In the embodiment shown, the guiding units 29*a*, 29*b* are arranged on both sides of the catch 23. Between the actuator 16 and the traversing carriage 20 an actuation mechanism 30 is interposed, which transmits the traversing motion 18 to the traversing carriage 20 or causes it. For the embodiment shown, the actuation mechanism 30 is formed with the actuation rod 15 and the coupling device 19. For this actuation mechanism 30, by means of the actuation rod 15 the traversing motion 18 is completely led through the spindle 8 realised as a hollow shaft 13, led radially outside in the region of the coupling device 19 and then radially on the outside is led back from the surface area of the spindle 8. In a semi-longitudinal section therefore a flow of power results that corresponds to a lying U, where the coupling device forms the base arm of the U, while the actuation rod forms the radially inner side arm of the U and the other parallel and radially outer side arm of the U is formed by the traversing carriage 20. This U-shaped flow of power with the two side arms surrounds the freely extending end portion of the spindle realised as a hollow shaft 13 in this semi-longitudinal section.

The winding machine 1 has a control unit 31. The electrical lines 32 to 35 connected with this are shown in FIG. 1 with dash-dotted lines. Via the line 32, the control unit 31 controls the drive 2 for inducing the desired course of the rotational motion 9. For guaranteeing a closed-loop control, the control unit 31 via the line 33 is fed a rotational speed signal of the drive 2. Furthermore, the power provision and control of the linear drive 17 is achieved via the control unit 31 via the line 34, where here for enabling a closed-loop control of the control unit 31 via the line 35 a rotational speed signal can be fed.

Figure 2:
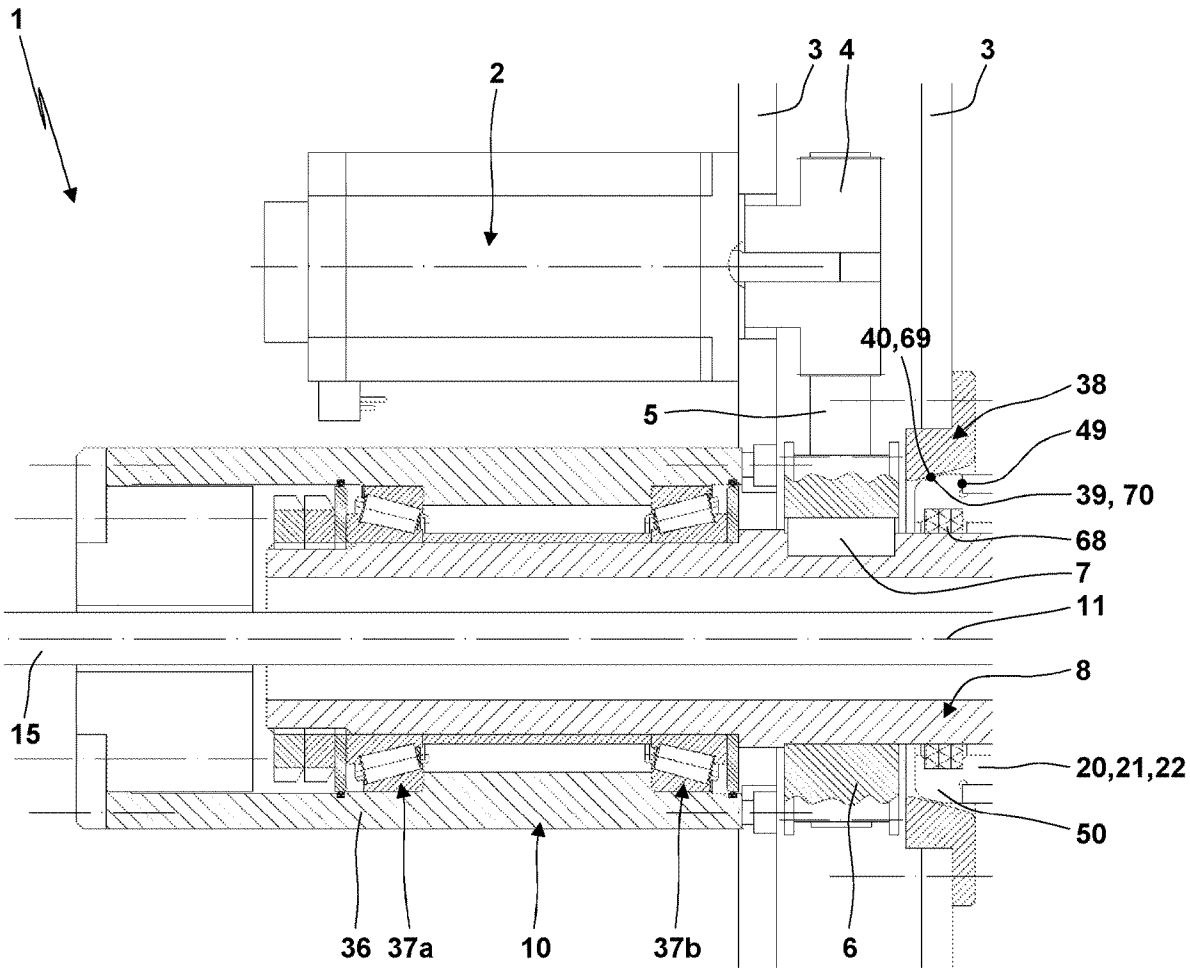
FIGS. 2 to 5 show details II to V of the winding machine according to FIG. 1.
Figure 3:
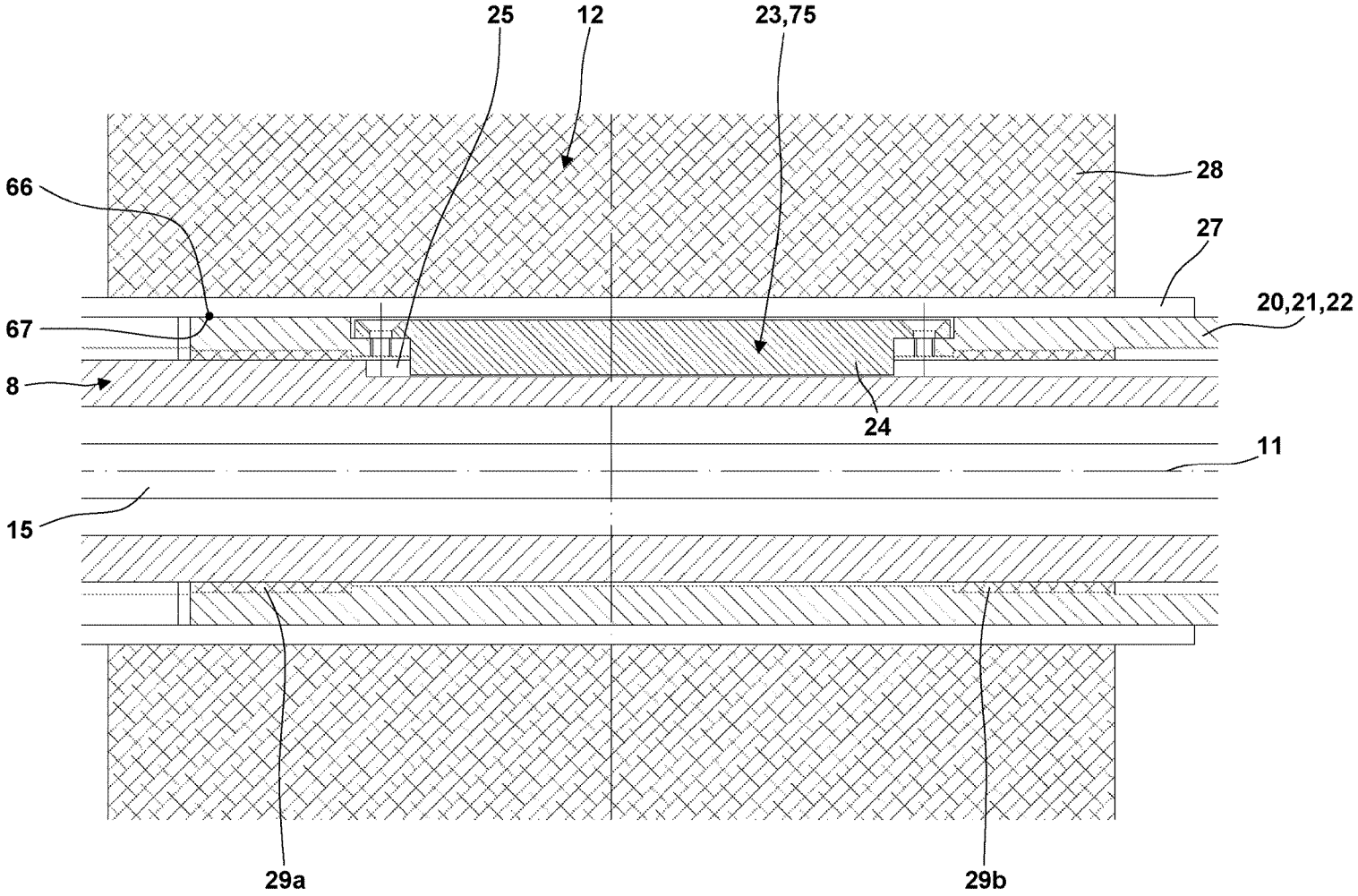

In the detail II according to FIG. 2, the spindle bearing 10 is formed with a sleeve-like bearing body 36 which is supported by the machine frame 3. On the sleeve-like bearing body 36, on the inner side bearing units 37*a*, 37*b* are braced via which in a way that is known as such the spindle 8 is supported with respect to the bearing body 36.

On the side turned towards the spool 12, on the machine frame 3 an actuation body 38 is held which forms an actuation surface 39 or a conical actuation surface 70 inclined with respect to the rotational axis 11. The actuation surface 39 or conical actuation surface 70 in a way that will be explained in detail in the following comes into interaction with an inclined surface 40 or a conical inclined surface 69 of the traversing carriage 20, the traversing sleeve 22 and the clamping sleeve 22 which is inclined correspondingly with respect to the rotational axis 11 and is arranged in the end region of the machine frame 3 turned towards the machine frame 3.

In FIG. 2 it is furthermore to be seen that the traversing carriage 20 is sealed with respect to the spindle 8 via a sealing unit 68 in the end region turned towards the machine frame 3.

Figure 4:
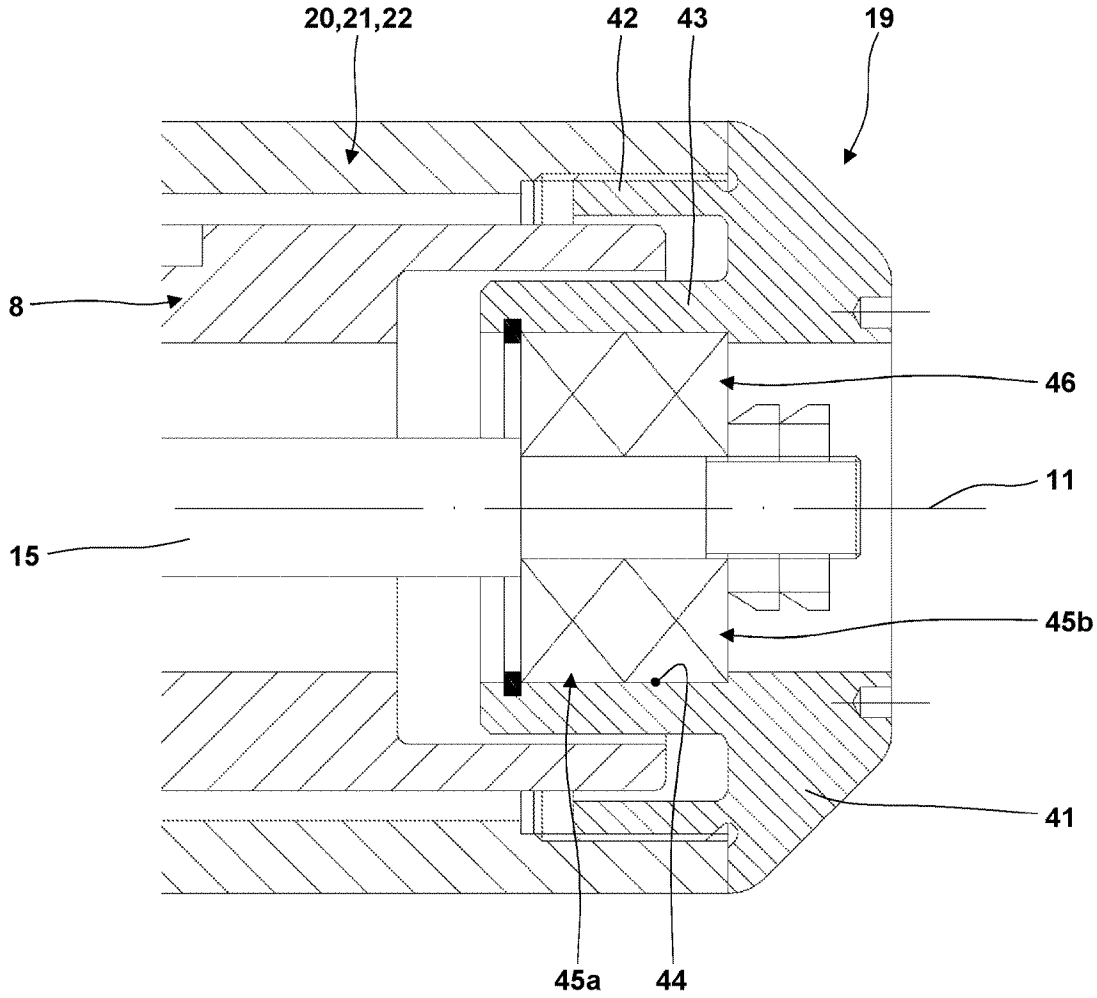

FIG. 4 shows the detail IV with a coupling device 19. The coupling device 19 has a lid 41. The lid 41 has two parallel, sleeve-like protrusions 42, 43. The outer protrusion 42 is screwed into an end-side inner thread of the traversing carriage 20 or the traversing sleeve 21 or clamping sleeve 22 with an outer thread. The protrusion 42 has an inner diameter which is larger than the outer diameter of the spindle 8. The sleeve-like protrusion 43 with its inner surface 44 forms a support surface for bearing units 45*a*, 45*b*. On the bearing units 45*a*, 45*b* on the radial inner side the assigned end region of the actuation rod 15 is supported. The bearings 45*a*, 45*b* in a way that is known as such, here via ledges, securing nuts and a securing ring, are axially secured with respect to the lid 41 on the one hand and with respect to the actuation rod 15 on the other hand. The bearing units 45*a*, 45*b* form an axial support 46, by means of which the traversing motion 18 is transmittable from the actuation rod 15 onto the traversing carriage 20. In the ring space formed between the sleeve-like protrusions 42, 43 in the position shown in FIG. 4, the end region of the spindle 8 here formed with steps can be arranged. For the embodiment shown, the lid 41 is realised with a through-bore via which the mounting and the tightening of the shaft nuts is enabled. In a way that is not shown, the coupling devices 19 and the lid 41 can each be closed with a closing element closing the through bore of the lid 41, so that as a whole the traversing carriage 20 and the coupling device 19 in the end region shown in FIG. 4 are closed and capsuled, so that no dirt created during the spooling process can enter into the interior where they could for example impede the function of the bearing units 45*a*, 45*c*.

Figure 5:
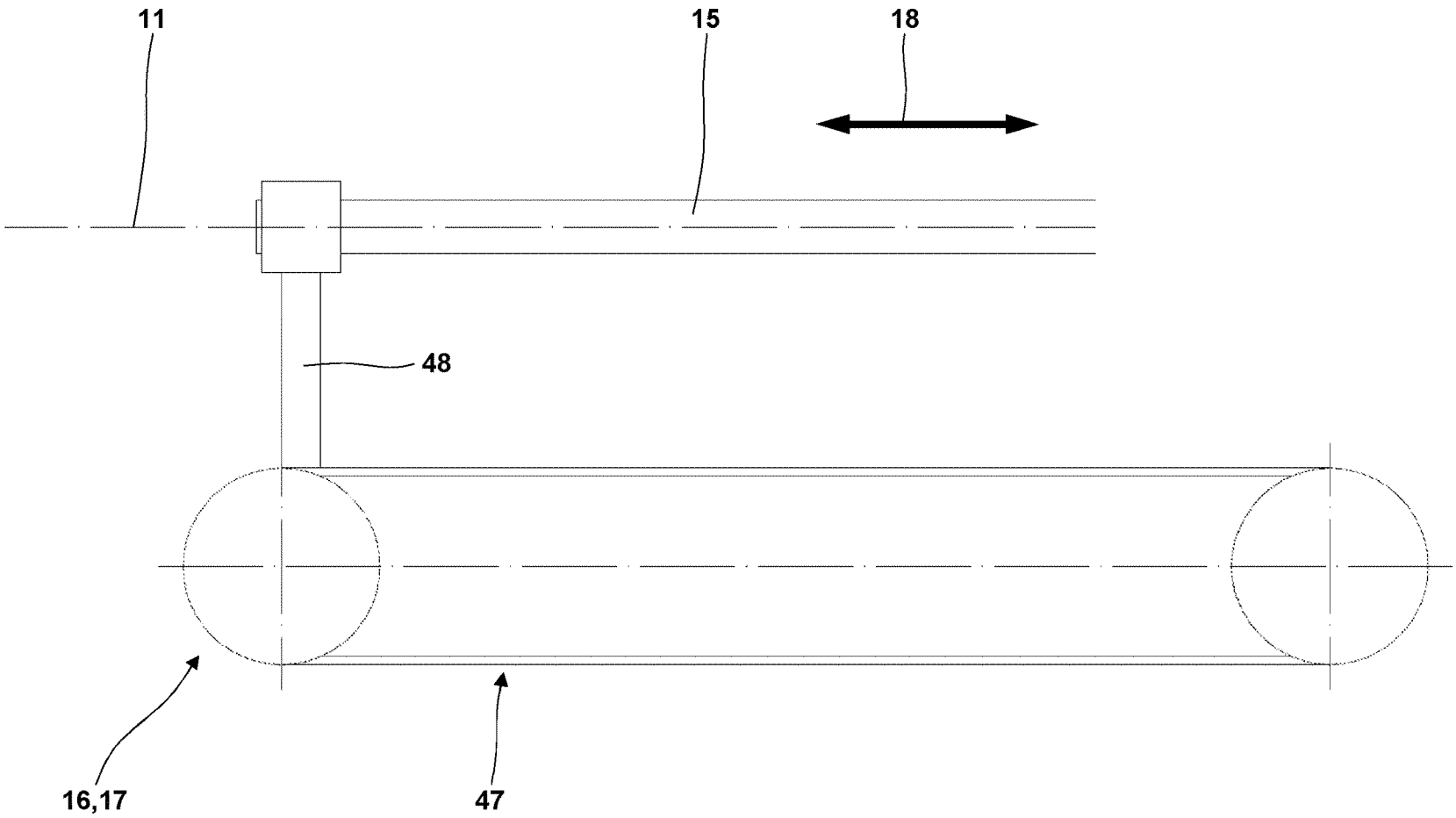

In FIG. 5, the actuator 16 realised as a linear drive 17 is shown in a larger detail V. The drive drives a belt pulley of the belt drive 47 back and forth. On the belt of the belt drive 47, a catch 48 is fixed which in turn is fixed to the end region of the actuation rod 15. In this way, the actuation of the actuator 16 with a motion back and forth of the belt drive 47 leads to the motion of the actuation rod 15 with the traversing motion 18.

The functioning of the winding machine according to FIGS. 1 to 6 is as follows:

To begin, with a spool sleeve 27 is pushed onto an empty spindle 8 and an empty traversing carriage 20 until it comes to rest on the front face against a rest 49. The rest 49 here is formed by a surrounding flange or collar 50 of the traversing carriage 20, the traversing sleeve 21 or the clamping sleeve 22, where the collar 50 on the side turned towards the machine frame 3 also forms the inclined surface 40 or the conical inclined surface 69.

Subsequently, the spool sleeve clamping device 26 is actuated, in which way a fixing of the spool sleeve 27 to the traversing carriage 20 is achieved which is rotationally fixed as well as secured axially.

Figure 6:
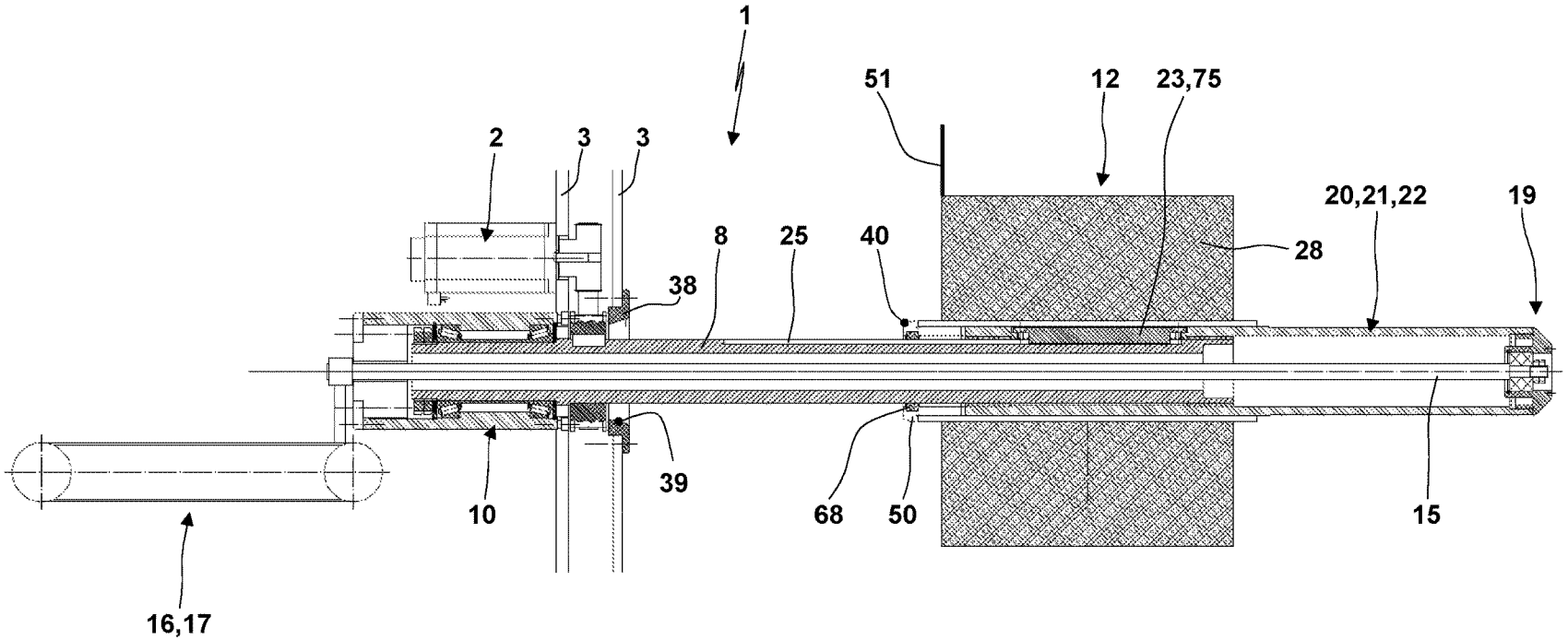
FIG. 6 in a vertical section shows a partial region of the winding machine according to FIGS. 1 to 5, where the traversing carriage here is in a front position.

Next, a winding good 51 is led towards the spool sleeve 27 in such a way that a winding is established. A catching device for the winding material 51 in the region of the winding machine 1 or the spool sleeve 27 can be provided that is known in itself. During the winding cycle then induced, the control unit 31 controls the drive 2 and the actuator 16 in a coordinated way so that in the creation of the winding 28 overlaying the traversing motion 18 and the rotational motion 9 a desired winding appearance is caused. FIG. 1 and FIG. 6 show the traversing carriage 20 and the spool 12 arranged on it in both end points of the traversing motion 18, that is, FIG. 1 a back end position with the smallest distance from the machine frame 3 and FIG. 6 a front end position with maximum distance from the machine frame 3. Between these end positions, with the traversing motion the motion of the traversing carriage 20 with the spool 12 arranged on it occurs in such a way that a winding good 51 is always fed from the same place without the necessity of the use of a traversing device with a traversing thread guide, where in an ideal case there is always a feeding of the winding good 51 perpendicular to the rotational axis 11.

At finishing the winding 28, the spool sleeve clamping device 26 is released so that removal of the completely wound spool 12 from the traversing carriage 20 is possible. In a way known as such, at first a clipping of the winding good can occur. It is possible that the control unit 31 is equipped with a control logic by means of which purposely there can be a feeding of the winding good by a corresponding motion of the traversing carriage 20 to a catching device and/or a cutting device. This preferably occurs in a motional region of the actuator 16 which is not inside the usual stroke of the traversing motion 18 but outside it.

For the embodiment shown, the control unit 31 is equipped with control logic in such a way that the actuation of the spool sleeve clamping device 26 is achieved in a motion-controlled way via controlling the actuator 16, in order to do which the actuator 16 is controlled into a position which is outside the usual actuation path for the traversing motion 18. In this actuation position, for creating an actuation force via the actuator 16, the inclined surface 40 of the traversing carriage 20 is pressed against the actuation surface 39 fixed to the machine frame 3. Without creating this actuation force, the spool sleeve clamping device 26 is actuated in such a way that the spool sleeve 27 is held fixedly to the traversing carriage 20, while with creating the actuation force, the spool sleeve clamping device 26 is deactivated so that the spool sleeve 27 can be pushed slidably onto the traversing carriage 20 or be removed from it.

Figure 7:
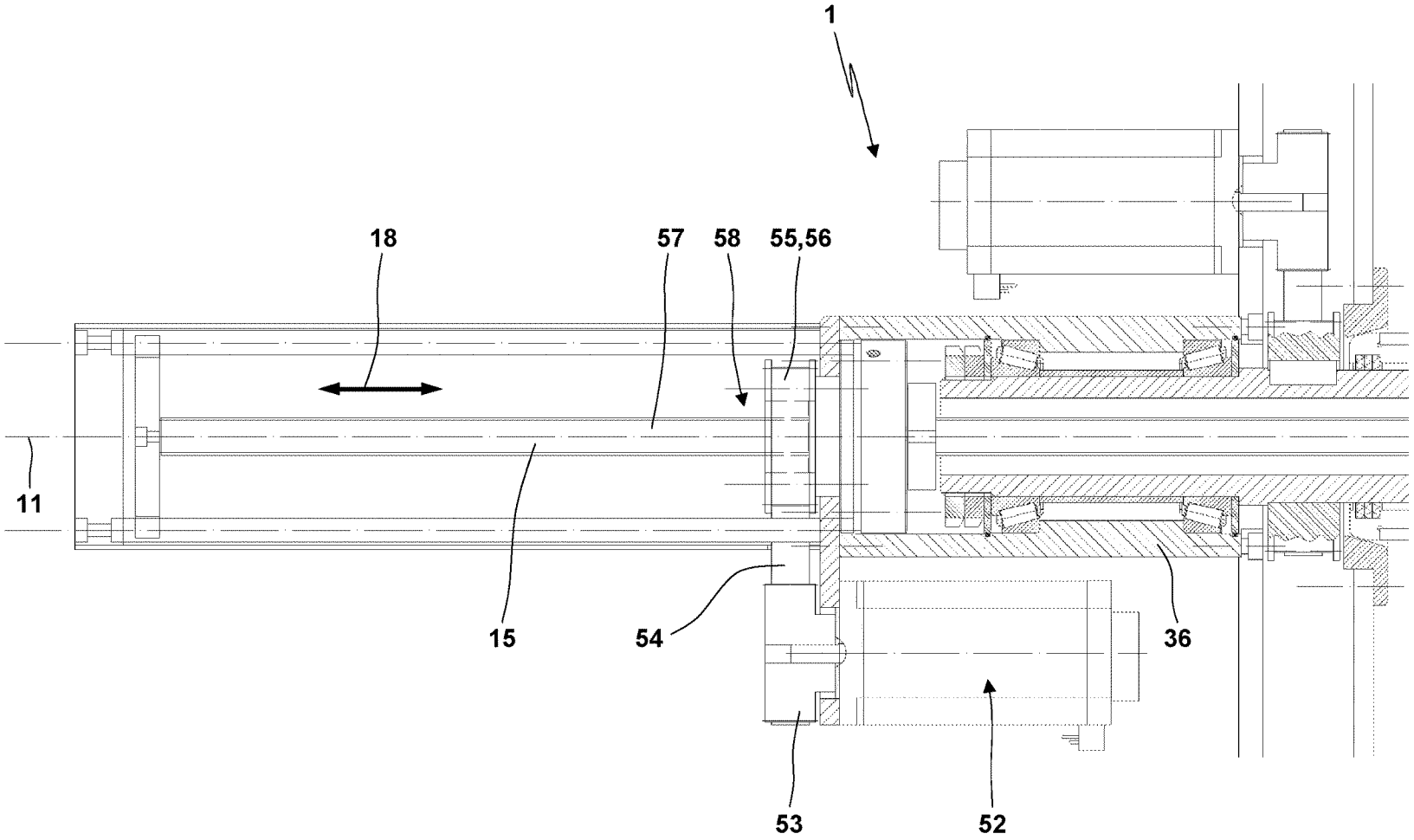
FIG. 7 shows a partial region of a winding machine with a drive designed differently to the drive according to FIGS. 1, 5 and 6 for creating the traversing motion of the traversing carriage.

For creating the traversing motion 18 (with apart from that corresponding realisation of the winding machine 1), any actuator 16 can be employed. For the embodiment shown in FIG. 7, an electrical drive 52 is employed the drive wheel 53 of which via a traction mechanism 54 drives an output-side drive wheel 55 which is supported rotatably but axially fixed on a bearing body 36. The output-side drive wheel 55 forms a spindle nut 56 which with the spindle 57 forms a spindle drive 58. For the embodiment shown, the spindle 57 is formed with the side end region of the actuation rod 15 which in order to achieve this is equipped with an outer thread with which the spindle nut 57 is screwed. The motion of the spindle nut 56 caused by the drive 52 therefore results in the axial motion of the spindle 57 and therefore of the actuation rod 15, so that via the control of the drive 52 the traversing motion 18 can be caused.

Figure 8:
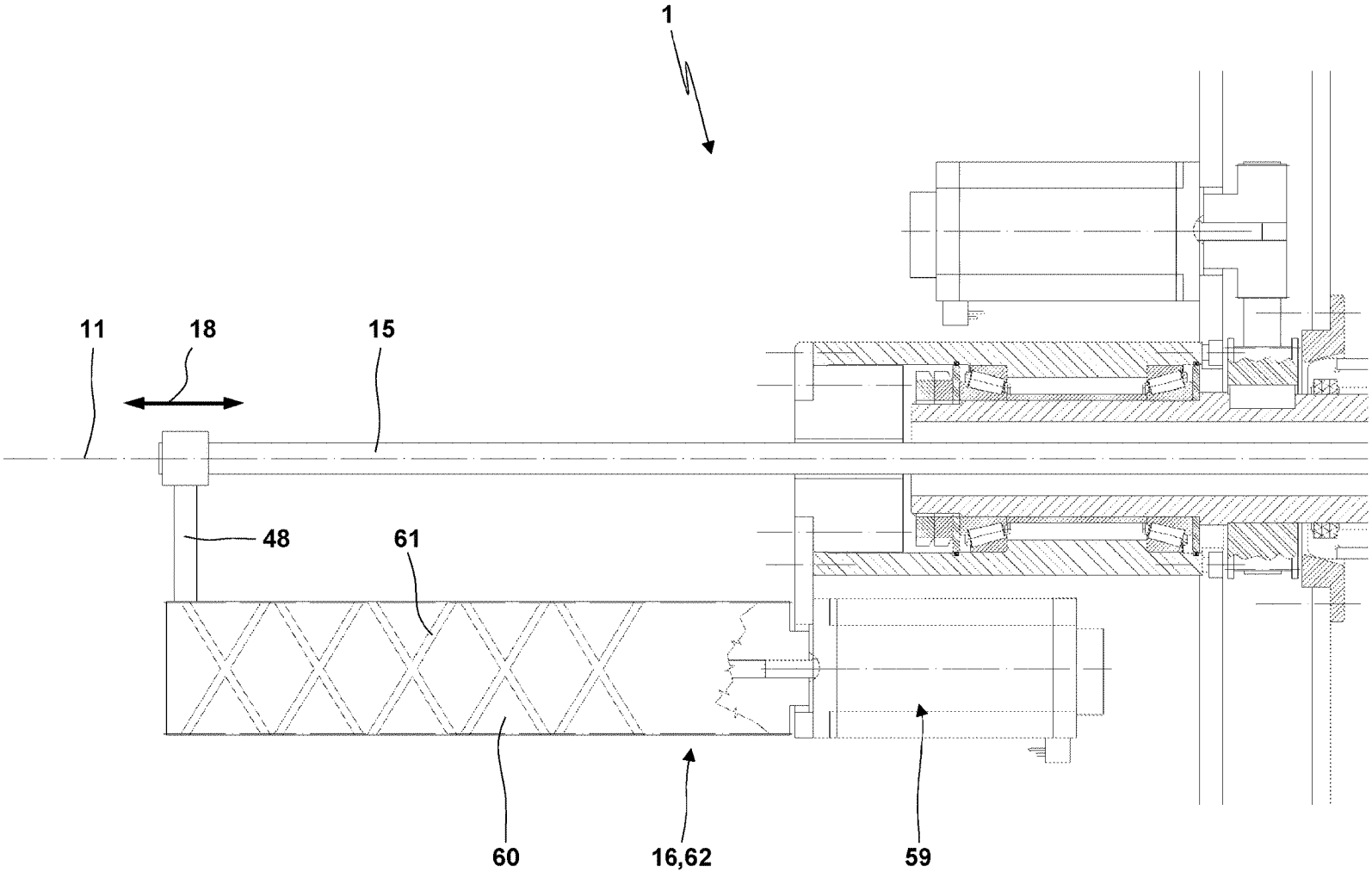
FIG. 8 shows a partial region of a winding machine with a drive realized differently to the transmission according to FIGS. 1, 5 and 6 and according to FIG. 7 for creating the traversing motion of the traversing carriage.

FIG. 8 shows a further possibility for the realisation of the actuator 16. An electrical drive 59 drives a traverse cam 60 where a gliding element supported by the screw thread drive catch or traverse cam catch 48 engages with the reverse threading 61 of the traverse cam 60, in which way a self reversing screw drive 62 for causing the traversing motion 18 is formed.

Figure 9:
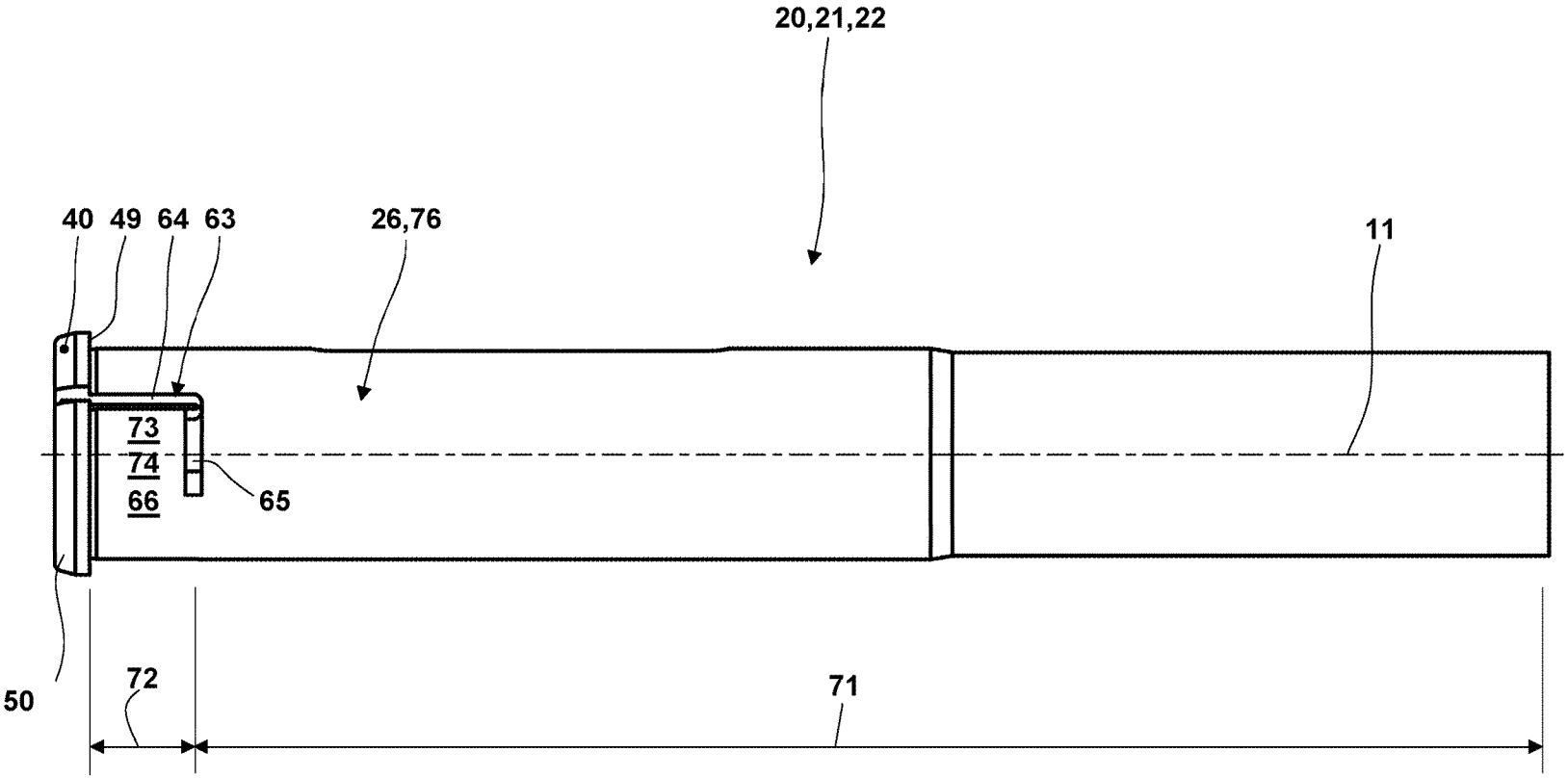
FIG. 9 shows a spool sleeve clamping device formed with an elastically radially deformable clamping sleeve for coupling the traversing carriage with a spool sleeve.

Within the framework of the invention, any spool sleeve clamping device 26 can be employed. For the spool sleeve clamping device 26 in an exemplary way used in the previous figures, the traversing carriage 20, here the traversing sleeve 21, is realised as a clamping sleeve 22 which as a single part is shown in FIG. 9. The clamping sleeve 22 in an end region forms the collar 50 which forms the inclined surface 40 or the conical inclined surface 69 and the rest 49. In order to simplify it, further details of the clamping sleeve 22 and the opening for the catch 23, fixing bores for the bolting of the catch 23 to the clamping sleeve 22 and similar are not shown.

In FIG. 9 it can be seen that the clamping sleeve 22 is realised with a slit 63. While generally the slit 63 can be arranged in any axial region of the clamping sleeve 22 as far as this axial region has an overlap with the region in which the spooling sleeve 27 is to be clamped and the slit 63 can have any shape with a constant or varying width and any contour, according to FIG. 9 a clamping sleeve 22 is employed with a slit 63 inserted from the side of the machine frame 3 on the front face. The slit 63 has a first portion 64 which is oriented in parallel to the longitudinal or rotational axis 11 and a second portion 65 which extends in the circumferential direction from the inner end region of the portion 64 so that the two portions 64, 65 are arranged L-shaped in a flat projection. The slit 63 in the region of the portions 64, 65 has a constant and continuous width. With the slit 63 a weakening of the material of the clamping sleeve 22 is provided, so that the clamping sleeve 22 in the surrounding region of the slit 63 forms a deformation portion 74 which can be deformed with a smaller actuation force than this would be the case in another axial portion of the clamping sleeve 22. If, as has been explained before, for the actuation of the spool sleeve clamping device 26 the inclined surface 40 touches the actuation surface 39 of the actuation body 38, on the inclined surface 40 of the clamping sleeve 22 an actuation force is caused which presses the collar 50 radially inside. Through this, there is an elastic deformation of the clamping sleeve 22 with a reduction of the diameter of the surface area 66. With creating the actuation force which is induced by the actuator 16, the clamping sleeve 22 is brought into an elastically deformed state in which the diameter of the surface area 66 of the clamping sleeve 22 is marginally smaller than the diameter of the inner surface 67 of the spool sleeve 27 so that in this actuated state the spool sleeve 27 can be pushed onto the clamping sleeve 22 or (with the completely wound spool 12) can be removed from it. If, on the contrary, the actuator 16 is actuated in such a way that the collar 50 moves away from the actuation body 38, the actuation force is removed and there is an elastic expanding of the clamping sleeve, in which way the surface area 66 of the clamping sleeve 22 is pressed against the inner surface 67 of the spool sleeve 27 from the inside, and a transmission of the rotational motion 9 and the traversing motion 18 can occur. Preferably, the actuation surface 39 and the inclined surface 40 are realised as conical actuation surface 70 and conical inclined surface 69, where preferably the opening angle of the cone becomes lager than a self-locking angle.

The clamping sleeve 22 has an axial portion 71 in which the surface area 66 has an outer diameter in such a way that a play or a form fit to the inner surface 67 of the spool sleeve 27 results. In at least one further axial portion 72, which is arranged directly neighbouring the inclined surface 40 and/or the collar 50, the surface area 66 of the clamping sleeve 22 has an outer diameter which in an unloaded state is marginally larger than the inner diameter of the inner surface 67 of the spool sleeve 27, so that without effect of the actuation force in the region of the inclined surface 40 a clamping of the spool sleeve 27 onto the clamping sleeve 22 results. In this axial portion 72, the surface area 66 of the clamping sleeve 22 forms a contact surface 73 which in the clamping position is pressed against the inner surface 67 of the spool sleeve 27. The contact surface 73 in the axial portion 72

- can be realised as continuous in the circumferential direction and over the entire circumference be pressed against the inner surface 67 of the spool sleeve or
- can only be realised in a partial circumferential portion which can for example be limited by the slit 63, where (possible with several slits 63) several contact surfaces 73 can be arranged distributed in the circumferential direction.

For the embodiment shown, the slit 63 separates a bowl- or bar-shaped segment of the clamping sleeve 22 oriented in the circumferential direction. This segment can be bent radially inwards around an axis oriented parallel to the longitudinal axis 11 with a bent bending rod oriented in the circumferential direction under creating the actuation force on the inclined surface 40, where a deformation region 74 in which the bending occurs is mostly arranged in the connecting region or "clamping region" of the separated bowl-shaped segment, while the contact surface 73 is mostly arranged in the end region of the separated bowl-shaped segment turned towards the portion 64 of the slit 63. For one of the multitudinous possible alternative embodiments, several slits 63 distributed around the circumference are only equipped with the axial portion 64 (that is, without portions 65). Between neighbouring slits 63, spring arms extending in parallel to the longitudinal axis 11 are then formed by the clamping sleeve 22, which are connected to the axial portion 71 in an end region while in the other end region it forms the collar 50 with inclined surfaces 40 each. In this case, the creation of the actuation force on the inclined surface 40 leads to the spring arms being bent around an axis oriented in the circumferential direction. Any other strains on the clamping sleeve 11 in the axial portion 72 for creating the radial clamping force or removing the radial clamping force are also possible.

Figure 10:
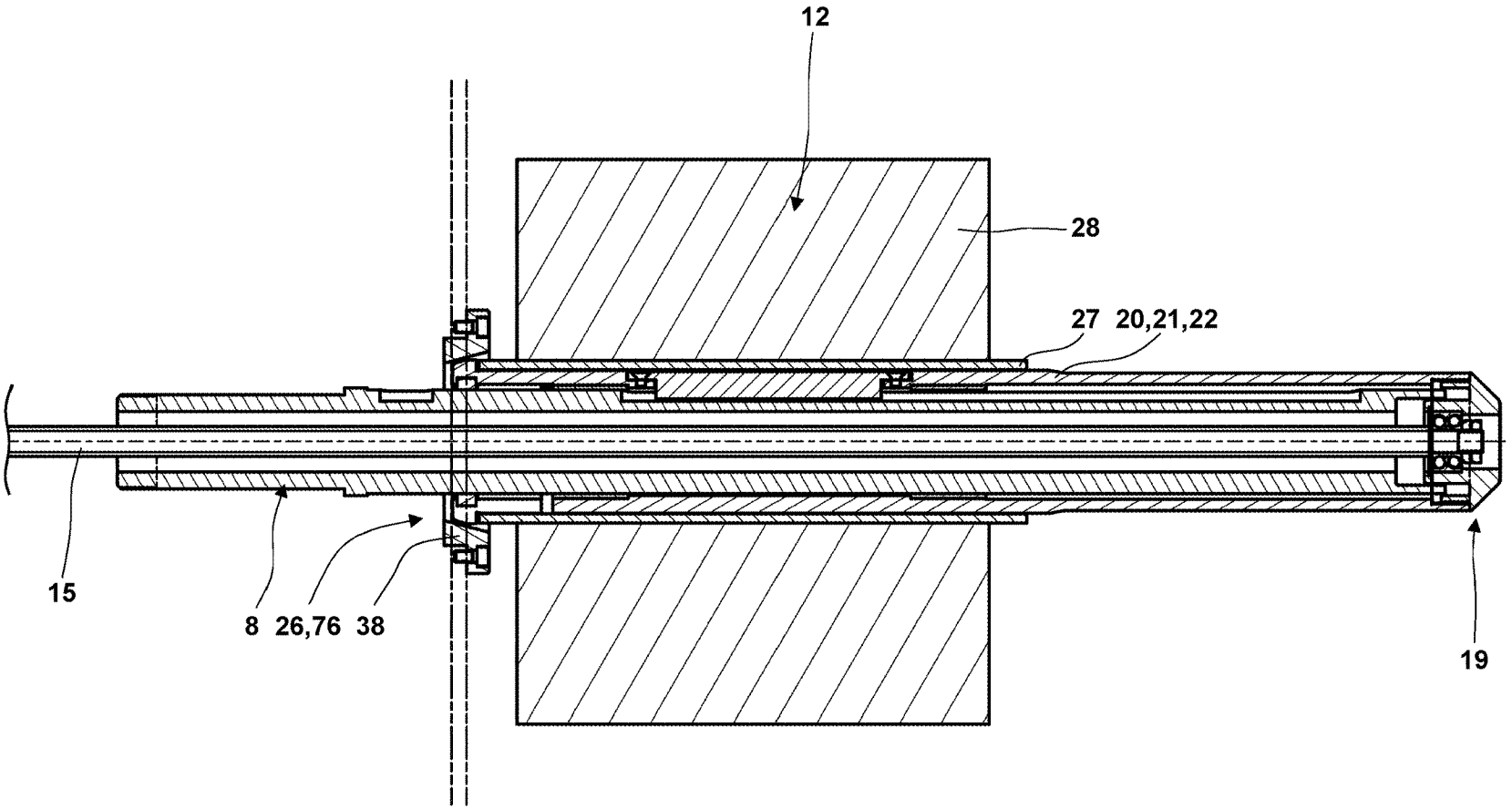
FIG. 10 shows a partial region of a winding machine in a vertical section with the spool sleeve clamping device according to FIG. 9.

FIG. 10 shows the interaction of the clamping sleeve 22 with the spool sleeve 27. The clamping sleeve 22 forms the surface area 66 which without actuation is pressed against the inner surface 67 of the spool sleeve 27.

The winding material 51 can for example be threads, yarns, ribbons or tapes, wires, stranded wires, monofilaments, multifilaments or similar. It is possible that the control unit 31 is equipped with control logic in such a way that a removal of the completely wound spool 2 and an insertion of a new spool sleeve 27 is made possible by the traversing carriage 20 being moved into a removal position outside of the usual stroke for the traversing motion 18.

The present winding machine 1 with regard to further aspects can be realised corresponding to the usual winding machines. For example, the measures according to the invention can be employed for winding machines which have two or more spindle units which are for example held on a revolver and where alternatingly one spindle unit is brought into a changing position while the other spindle unit is in a winding position. It is also possible that the invention is used for a winding machine in which on one spindle and a common traversing carriage or several traversing carriages several spools are arranged one behind the other and are wound at the same time. It is also possible that several concentrically arranged spools on two spindles are each created.

For the embodiment shown, the actuation of the traversing carriage 20 is done from the free end region of the spindle, in order to achieve which the leading of the traversing motion through the spindle is done by means of the actuation rod. It is alternatively possible that the actuation rod extends only up to the axial region in which the spool 12 is arranged and engages with a circumferential groove of the traversing carriage with a radially oriented pin which extends through an elongated slit of the spindle. Finally, it is also possible that the actuation of the traversing carriage 20 occurs from the side turned towards the machine frame 3 and radially on the outside as seen from the spindle.

It is possible also that several slits 63 of any and of the same or different shapes are provided on the clamping sleeve 22.

It is possible that through the radial clamping of the surface area 66 of the clamping sleeve 22 to the inner surface 67 of the spool sleeve 27 a friction-locking is induced which avoids an axial relative motion of the spool sleeve 27, possibly with the winding 28 formed on it, with respect to the clamping sleeve 22. Furthermore, by means of this friction-locking there can also be the transmission of the driving motion from the clamping sleeve 22 to the spool sleeve 27. Finally, a position fixing of the spool sleeve 22, possibly with the winding 28 formed on it, to the clamping sleeve 22 can occur with coaxial arrangement and centering of the spool sleeve 27 on the clamping sleeve 22.

For a different embodiment, in addition to the friction-locking between the clamping sleeve 22 and the spool sleeve 27 also a form-locking in the circumferential direction can be used to transmit the driving motion from the clamping sleeve 22 to the spool sleeve 27. To mention only an example, the spool sleeve 27 in the end region turned towards the machine frame 3 can comprise at least one axial slit, an opening or a groove with which a rib, a protrusion or an axially orientated pin of the clamping sleeve 22 engages with a pushing of the spool sleeve 27 onto the clamping sleeve 22. Via the connection between the slit, opening or groove and the protrusion, the rib or the pin, then there can be the transmission of the driving motion from the clamping sleeve 22 onto the spool sleeve 27. The other way around, the spool sleeve 27 can have a radially inwards oriented protrusion, a rib or a pin which then engages with an opening, a groove or a slit in the clamping sleeve 22. In the two mentioned cases then the friction-locking between the clamping sleeve 22 and the spool sleeve 27 is only or preferentially responsible for the axial fixing of the spool sleeve 27 on the clamping sleeve 22 and/or the centering or the pre-setting of the coaxial position of the spool sleeve 27 on the clamping sleeve 22. It is understood that a form-locking and a friction-locking can also complement each other for the transmission of the moment of torque. Possibly, for the transmission of the moment of torque via a form-locking, the application of the spool sleeve 27 onto the clamping sleeve 22 occurs for a given circumferential orientation of the spool sleeve 27 relative to the clamping sleeve 22.

The diameter, the wall strength, the material and the stiffness of the clamping sleeve 22 are preferably chosen in such a way that with the actuation of the clamping sleeve 22 a radial deformation results which results in a change of the radius of the clamping sleeve 22 in the region of the contact surface 73 in the region of 0.2 mm to 35.0 mm, especially 0.5 mm to 20.0 mm or 0.5 mm to 15.0 mm. The surface area 66 in the region of the contact surface 73 in the actuated configuration preferably has a radius which corresponds to the nominal size of the radius of the inner surface 67 of the spool sleeve 27 (possibly forming a play), while in the not actuated configuration without the spool sleeve 27 arranged on it the surface area 66 of the clamping sleeve 22 has a size that is larger by 0.5 mm to 20 mm with respect to the nominal size of the spool sleeve 27. The moment of torque transferable in a friction-locking way via the clamping sleeve 22 is strongly influenced by the material and the material strength of the clamping sleeve 22 and the spool sleeve 27. It is possible that the friction conditions between spool sleeve 27 and clamping sleeve 22 are influenced by a suitable coating of the surface area 66 and/or the inner surface 67 increasing the friction, for example with a coating made of rubber at least in the region of the contact surface 73. It is possible that the spool sleeve 27 is made of paper, plastic, aluminium or steel. The clamping sleeve 22 is preferably made of steel, aluminium or plastic. The moment of torque transmitted in a friction-locking way from the clamping sleeve 22 onto the spool sleeve 27 preferably is larger than 100 Nm.

For the shown embodiment a first coupling element 75 for transmitting the rotational movement of the spindle 8 to the traversing carriage 20 is embodied as the catch 23 and a second coupling element 76 for transmitting the traversing movement (and optionally also the rotational movement) of the traversing carriage 20 to the spool sleeve 27 is embodied as the spool sleeve clamping device 26. However, also other embodiments of the coupling elements 75, 76 for transmitting these movements are covered by the present invention.

Many variations and modifications may be made to the preferred embodiments of the invention without departing substantially from the spirit and principles of the invention. All such modifications and variations are intended to be included herein within the scope of the present invention, as defined by the following claims.

I claim:

1. A winding machine for a traversing application of a winding material to a spool sleeve comprising a) a spindle,
 said spindle being supported for being rotated and for having a fixed axial position and
 said spindle having an inner recess, b) a drive driving the spindle for a rotational movement, c) a traversing carriage, said traversing carriage being supported on the spindle for being movable with a traversing motion in an axial direction relative to the spindle, d) a first coupling element for transmitting the rotational movement of the spindle to the traversing carriage and e) a second coupling element for transmitting the traversing motion of the traversing carriage to the spool sleeve, f) an actuation mechanism,
 said actuation mechanism executing the traversing motion, said actuation mechanism comprising a coupling device which is coupled to the traversing carriage for transmitting the traversing motion from the actuation mechanism to the traversing carriage and said actuation mechanism extending through the inner recess of the spindle.

2. The winding machine of claim 1, wherein the first coupling element interacts with the spindle for transmitting the rotational movement of the spindle to the traversing carriage by a form-locking engagement in circumferential direction.

3. The winding machine of claim 2, wherein the traversing carriage comprises a traversing sleeve and the spindle extends through the traversing sleeve.

4. The winding machine of claim 3, wherein the first coupling element is a catch which is mounted to the traversing sleeve and which couples the spindle to the traversing sleeve by a form-locking engagement in circumferential direction.

5. The winding machine of claim 1, wherein the traversing carriage comprises a traversing sleeve and the spindle extends through the traversing sleeve.

6. The winding machine of claim 1, wherein the actuation mechanism comprises an actuation rod, said actuation rod extending through the inner recess of the spindle, said actuation rod executing the traversing motion and said actuation rod extending up to a free end portion of the spindle, where the actuation rod is coupled by the coupling device to the traversing carriage.

7. The winding machine of claim 6, wherein the coupling device comprises an axial support, which transmits the traversing motion from the actuation rod to the traversing carriage and enables a relative rotating motion of the traversing carriage relative to the actuation rod.

8. The winding machine of claim 7, wherein the coupling device closes off the inner recess of the spindle on a front side.

9. The winding machine of claim 6, wherein the coupling device closes off the inner recess of the spindle on a front side.

10. The winding machine of claim 1, wherein the second coupling element is a spool sleeve clamping device.

11. The winding machine of claim 10, wherein the spool sleeve clamping device a) comprises a not actuated configuration achieved without an actuation of the spool sleeve clamping device wherein the spool sleeve clamping device takes up its clamping position, in which the rotating motion of the traversing carriage and the traversing motion of the traversing carriage is transmitted by the spool sleeve clamping device to the spool sleeve, and b) comprises a release configuration achieved with an actuation of the spool sleeve clamping device wherein the spool sleeve clamping device releases the spool sleeve such that it is possible to remove the spool sleeve from the traversing carriage.

12. The winding machine of claim 11, wherein the spool sleeve clamping device comprises a radially, elastically deformable clamping sleeve which without actuation of the spool sleeve clamping device takes up the not actuated configuration, in which a surface area is spread in radial outer direction against an inner surface of the spool sleeve.

13. The winding machine of claim 12, wherein the spool sleeve clamping device is actuated and/or released in a way controlled by the motion of the traversing carriage.

14. The winding machine of claim 13, wherein the clamping sleeve comprises an inclined surface, which in a way controlled by motion is pressed to an actuation surface by the traversing motion of the traversing carriage, where the actuation force exerted onto the inclined surface by the actuation surface causes a radial elastic deformation of the clamping sleeve.

15. The winding machine of claim 11, wherein the spool sleeve clamping device is actuated and/or released in a way controlled by the motion of the traversing carriage.

16. The winding machine of claim 1, wherein the traversing motion is generated by a spindle drive.

17. The winding machine of claim 1, wherein the traversing motion is generated by an electric linear drive which is coupled to the traversing carriage.

18. The winding machine of claim 1, wherein the traversing motion is generated by a self reversing screw drive, where a traverse cam of the self reversing screw drive is driven by an electrical drive and in a reverse threading of the traverse cam a traverse cam catch is guided that is fixed against rotation but axially displaceably supported and that is coupled to the traversing carriage.

* * * * *